US007588325B2

(12) United States Patent
Moynihan

(10) Patent No.: US 7,588,325 B2
(45) Date of Patent: Sep. 15, 2009

(54) PRINTHEADS AND SYSTEMS USING PRINTHEADS

(75) Inventor: Edward R. Moynihan, Plainfield, NH (US)

(73) Assignee: FUJIFILM Dimatix, Inc., Lebanon, NH (US)

( * ) Notice: Subject to any disclaimer, the term of this patent is extended or adjusted under 35 U.S.C. 154(b) by 252 days.

(21) Appl. No.: 11/292,574

(22) Filed: Dec. 2, 2005

(65) Prior Publication Data

US 2006/0132537 A1 Jun. 22, 2006

Related U.S. Application Data

(60) Provisional application No. 60/632,803, filed on Dec. 3, 2004.

(51) Int. Cl.
*B41J 2/175* (2006.01)

(52) U.S. Cl. ..... 347/85

(58) Field of Classification Search ..... 347/49, 347/84, 85; 141/2, 18
See application file for complete search history.

(56) References Cited

U.S. PATENT DOCUMENTS

| | | | | |
|---|---|---|---|---|
| 4,437,104 | A * | 3/1984 | Hudson | 347/86 |
| 4,908,638 | A | 3/1990 | Albosta et al. | |
| 4,999,651 | A * | 3/1991 | Duffield et al. | 347/3 |
| 5,265,315 | A | 11/1993 | Hoisington et al. | |
| 5,371,529 | A * | 12/1994 | Eguchi et al. | 347/7 |
| 5,988,782 | A * | 11/1999 | Miura et al. | 347/6 |
| 6,024,441 | A | 2/2000 | Nishimoto | |
| 6,109,737 | A * | 8/2000 | Kishima | 347/70 |
| 6,145,961 | A | 11/2000 | Otsuki | |
| 6,199,976 | B1 * | 3/2001 | Sasada | 347/85 |
| 6,634,742 | B2 * | 10/2003 | Owaki et al. | 347/93 |
| 6,705,711 | B1 * | 3/2004 | Richards | 347/85 |
| 6,769,766 | B2 * | 8/2004 | Suzuki et al. | 347/100 |
| 7,380,920 | B2 * | 6/2008 | Sonnichsen et al. | 347/84 |
| 2004/0135829 | A1 | 7/2004 | Yoshida | |

FOREIGN PATENT DOCUMENTS

| | | |
|---|---|---|
| EP | 1 452 322 | 9/2004 |
| EP | 1 819 518 | 8/2007 |
| KR | 2007-0097480 | 10/2007 |
| WO | WO2006/060622 | 6/2006 |

OTHER PUBLICATIONS

U.S. Appl. No. 10/189,947, filed Apr. 3, 2002, Bibl et al.
Office Action dated Feb. 2, 2009 received in corresponding European application No. 05826295.7.
Office Action dated Mar. 6, 2009 received in corresponding Chinese application No. 200580047237.4.

* cited by examiner

*Primary Examiner*—Anh T. N. Vo
(74) *Attorney, Agent, or Firm*—Fish & Richardson P.C.

(57) ABSTRACT

In general, in one aspect, the invention features an apparatus, including a jetting assembly that has a plurality of nozzles capable of ejecting droplets, and a first reservoir and a second reservoir, the first and second reservoirs being in fluid communication with the jetting assembly and with each other.

21 Claims, 2 Drawing Sheets

PRINTHEADS AND SYSTEMS USING PRINTHEADS

CROSS-REFERENCE TO RELATED APPLICATIONS

Under 35 U.S.C. §119(e)(1), this application claims benefit of Provisional Patent Application ser. No. 60/632,803, entitled "PRINTHEADS AND SYSTEMS USING PRINTHEADS," filed on Dec. 3, 2004, the entire contents of which are incorporated herein by reference.

TECHNICAL FIELD

This invention relates to printheads and systems using printheads.

BACKGROUND

Ink jet printers typically include an ink path from an ink supply to a nozzle path. The nozzle path terminates in a nozzle opening from which ink drops are ejected. Ink drop ejection is controlled by pressurizing ink in the ink path with an actuator, which may be, for example, a piezoelectric deflector, a thermal bubble jet generator, or an electro statically deflected element. A typical printhead includes a reservoir and a jetting assembly. The jetting assembly has an array of ink paths with corresponding nozzle openings and associated actuators, and drop ejection from each nozzle opening can be independently controlled. In a drop-on-demand printhead, each actuator is fired to selectively eject a drop at a specific pixel location of an image as the jetting assembly and a printing substrate are moved relative to one another. In high performance jetting assemblies, the nozzle openings typically have a diameter of 50 microns or less, e.g., around 25 microns, are separated at a pitch of 100-300 nozzles/inch, have a resolution of 100 to 3000 dpi or more, and provide drop sizes of about 1 to 70 picoliters (pl) or less. Drop ejection frequency is typically 10 kHz or more.

Hoisington et al. U.S. Pat. No. 5,265,315, the entire contents of which is hereby incorporated by reference, describes a jetting assembly having a semiconductor body and a piezoelectric actuator. The assembly body is made of silicon, which is etched to define ink chambers. Nozzle openings are defined by a separate nozzle plate, which is attached to the silicon body. The piezoelectric actuator has a layer of piezoelectric material, which changes geometry, or bends, in response to an applied voltage. The bending of the piezoelectric layer pressurizes ink in a pumping chamber located along the ink path.

Further examples of jetting assemblies are disclosed in U.S. patent application Ser. No. 10/189,947, entitled "PRINTHEAD," to Andreas Bibl et al., filed on Jul. 3, 2002, the entire contents of which are hereby incorporated by reference.

The amount of bending that a piezoelectric material exhibits for a given voltage is inversely proportional to the thickness of the material. As a result, as the thickness of the piezoelectric layer increases, the voltage requirement increases. To limit the voltage requirement for a given drop size, the deflecting wall area of the piezoelectric material may be increased. The large piezoelectric wall area may also require a correspondingly large pumping chamber, which can complicate design aspects such as maintenance of small orifice spacing for high-resolution printing.

In general, printheads can include one or more jetting assemblies. Printing systems can print in a single pass of the substrate relative to the printhead, or in multiple passes. Printheads can be used to jet inks and/or other fluids, such as materials used for electronic components (e.g., electrically conductive materials) or color filter materials for flat panel displays, for example.

SUMMARY

Unintended pressure variations within a jetting assembly can result in undesirable effects. For example, an increase in pressure can cause fluid to be undesirably ejected from jets in the jetting assembly. In contrast, a decrease in pressure can cause jets in the assembly to deprime. In other words, the reduced pressure can cause fluid to withdraw from the nozzle of the jet, causing the jet to ingest air which impacts the jets ability to eject fluid droplets.

Acceleration of a printhead causes pressure variations within the jetting assembly. The magnitude of such fluctuations is related to the distance between the reservoir and jetting assembly in the printhead. In general, for a given acceleration, the magnitude of a fluctuation will increase as the distance between the reservoir and the jetting assembly increases. Accordingly, in printheads where the jetting assembly is located relatively far from the fluid reservoir, acceleration associated with relatively modest movement of the printhead can cause undesirable jetting and/or depriming. For example, in embodiments where a reservoir serves a cluster of jetting assemblies, jets in some or all of the jetting assemblies can become deprimed when the jetting assemblies are moved for cleaning or other maintenance.

A printhead can include a pressure surge suppression mechanism to reduce the magnitude of pressure variations of fluid within a jetting assembly associated with movement of a printhead. Pressure surge suppression mechanisms can include, for example, a second reservoir in fluid communication with the first reservoir and the jetting assembly, or a compliance that allows for volume changes in a manifold supplying fluid from the reservoir to the jetting assembly.

In general, in one aspect, the invention features systems that include a printhead cluster configured to deposit droplets of a jetting fluid on a substrate, and a mounting frame for mounting the printhead cluster relative to the substrate, wherein the printhead cluster comprises a plurality of jetting assemblies and a pair of reservoirs configured to supply jetting fluid to the jetting assemblies.

Embodiments of the systems can include one or more of the following features and/or features of other aspects. For example, the systems can further include an electronic controller configured to maintain the jetting fluid volume in the reservoirs at about 95% or less of their maximum volume. The systems can include a first fluid conduit connecting the pair of reservoirs providing a path for the jetting fluid between the pair of reservoirs. The systems can further include additional fluid conduits providing a path for the jetting fluid from the first fluid conduit to the jetting assemblies. The additional fluid conduits can have narrower bores than the first fluid conduit. The systems can include a second fluid conduit different from the first fluid conduit, the second fluid conduit providing a path for jetting fluid from the reservoirs to the jetting assemblies. The mounting frame can include an assembly that allows the printhead cluster to be moved from a jetting position relative to the substrate to a second position remote from the substrate.

In another aspect, the invention features apparatus that include a jetting assembly having a plurality of nozzles capable of ejecting droplets, and a first reservoir and a second reservoir, the first and second reservoirs being in fluid communication with the jetting assembly and with each other.

Embodiments of the systems can include one or more of the following features and/or features of other aspects. For example, the jetting assembly can be located about 10 cm or more from the first reservoir. The jetting assembly can be located about 10 cm or more from the second reservoir. The first reservoir can be located about 10 cm or more from the second reservoir. The first and second reservoirs can reduce pressure variations of fluid in the jetting assembly caused by acceleration of the apparatus. The pressure variations can be sufficiently reduced so that the nozzles are substantially not deprimed when the apparatus accelerates by about 10 $ms^{-2}$ or less (e.g., about 9 $ms^{-2}$ or less, about 8 $ms^{-2}$ or less, about 7 $ms^{-2}$ or less, about 6 $ms^{-2}$ or less, about 5 $ms^{-2}$ or less, about 4 $ms^{-2}$ or less, about 3 $ms^{-2}$ or less, about 2 $ms^{-2}$ or less, about 2 $ms^{-2}$ or less, about 1 $ms^{-2}$ or less). The pressure variations can be sufficiently reduced so fluid in the ink jet print head module substantially does not leak from the nozzles when the apparatus accelerates by about 10 $ms^{-2}$ or less (e.g., about 9 $ms^{-2}$ or less, about 8 $ms^{-2}$ or less, about 7 $ms^{-2}$ or less, about 6 $ms^{-2}$ or less, about 5 $ms^{-2}$ or less, about 4 $ms^{-2}$ or less, about 3 $ms^{-2}$ or less, about 2 $ms^{-2}$ or less, about 2 $ms^{-2}$ or less, about 1 $ms^{-2}$ or less). The apparatus can include a frame having an opening, where the jetting assembly is positioned in the opening. The apparatus can further include one or more additional jetting assemblies positioned in corresponding openings in the frame. The first and second reservoirs are in fluid communication with the additional jetting assemblies. The frame can be a portion of an enclosure housing the jetting assembly and the first and second reservoirs.

The jetting assembly can include a body and a nozzle plate. The body of the jetting assembly can include a plurality of channels and a piezoelectric actuator, where the channels correspond to nozzles in the nozzle plate and the piezoelectric actuator is configured to cause pressure variations in a fluid in the channels to eject fluid droplets through the nozzles.

Embodiments of the invention can include one or more of the following advantages. Embodiments include printhead clusters with a pressure surge suppression mechanism. The pressure surge suppression mechanism can reduce depriming or unwanted jetting from jetting assemblies in the printhead clusters due to a "water hammer" effect associated with acceleration of the printhead cluster. This can reduce the downtime of a system due to a deprimed jetting assembly. This can also reduce unwanted jetting of ink. In some embodiments, dual reservoir systems can improve fluid flow and/or reduced starvation to jetting assemblies (e.g., assemblies located relatively far from the reservoirs).

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1A:
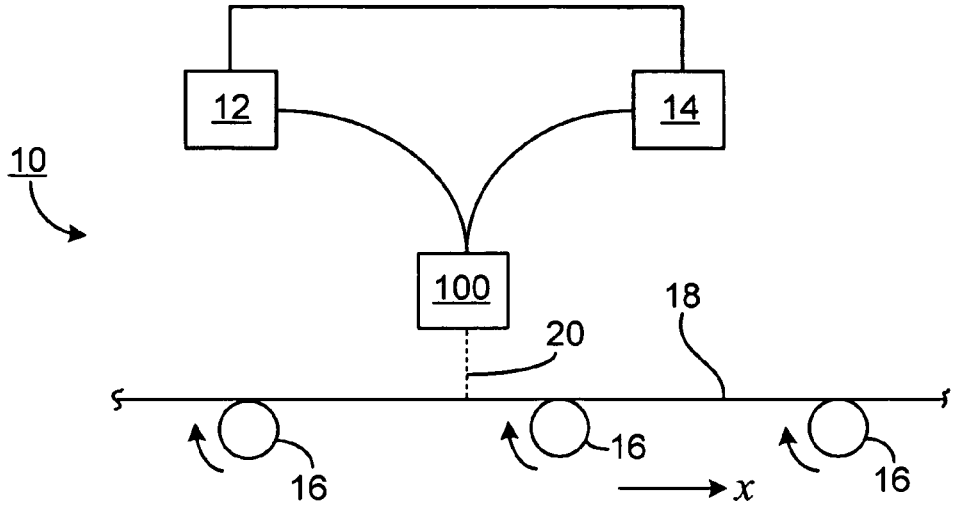
FIG. 1A is a schematic view of a printing line that includes a printhead cluster.

FIG. 1A shows a schematic view of a printing line 10 that includes a printhead cluster 100. Printhead cluster 100 is positioned relative to a continuous web substrate 18 so that jetting assemblies in the cluster deposited ink droplets 20 onto the substrate as the substrate moves past the cluster (in the x-direction). Printing line 10 includes rollers 16 that support continuous web substrate 18 and move the substrate past the cluster.

In some embodiments, printing line 10 can include additional printhead clusters (e.g., two or more printhead clusters, three or more printhead clusters, four or more printhead clusters).

Attached to printhead cluster 100 are a control module 12 and a supply reservoir 14. Control module 12 includes control electronics and a user interface that allows an operator to start, stop, and adjust the operation of printhead cluster 100. Control module 12 also includes electronics that control the timing of droplet ejection from the jetting assemblies to synchronize the jetting with the position of the moving substrate.

Control module 12 is in communication with supply reservoir 14 and coordinates filling of reservoirs in printhead cluster 100 with ink in supply reservoir 14. Electronic components in control module 12 receive signals from ink level sensors in printhead cluster 100 indicating when additional ink is required in the printhead cluster reservoirs. Upon receiving these signals, control module 12 sends a signal to supply reservoir 14 causing a pump attached to the supply reservoir to pump a volume of ink from the reservoir to printhead cluster 100.

While each reservoir in printhead cluster 100 includes an ink level sensor, in certain embodiments only one of the reservoirs includes an ink level sensor. The control module can supply ink to both reservoirs based on a signal from the one ink level sensor.

Figure 1B:
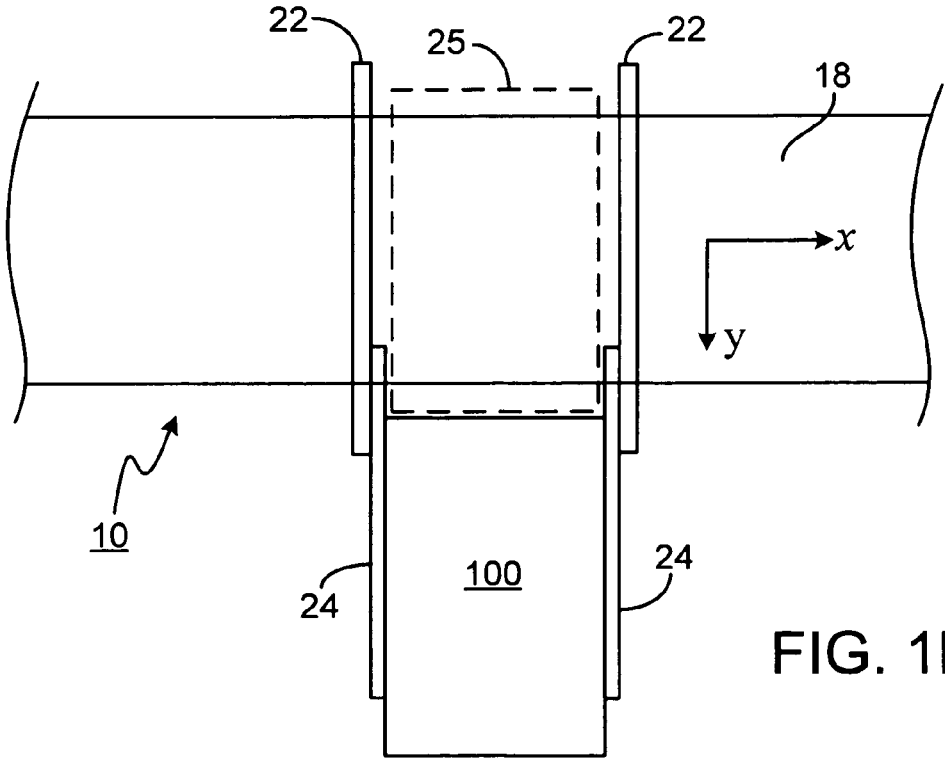
FIG. 1B is a plan view of the printing line showing in FIG 1A.

Referring also to FIG. 1B, printhead cluster 100 is mounted to a mounting frame 22, which suspends the cluster above continuous web substrate 18. The mounting fixture of mounting frame 22 includes a sliding bracket 24, which allows an operator to move the printhead cluster laterally (in the y-direction) from a position 25 above the substrate to a position away from the substrate, as shown in FIG 1B, without detaching the printhead cluster from the mounting frame. In the position away from the substrate, an operator can more easily access the components in the printhead cluster compared with when the printhead cluster is in position 25. This allows easier maintenance of the components of the printhead cluster. Sliding the printhead cluster between the two positions causes acceleration of the printhead cluster. As described, infra, embodiments of the printhead cluster includes components that reduce (e.g., eliminate) unwanted fluid ejection or jet depriming that may occur as a result of this acceleration.

In general, the nature of the continuous web substrate may vary. In some embodiments, the web is a paper web. In certain embodiments, the web can include a polymer (e.g., an extruded or cast polymer web). In embodiments, the web can be formed from a food product (e.g., dough).

Furthermore, while substrate 18 is a continuous web substrate, in some embodiments, the substrate can be in non-continuous form. For example, rather than a continuous web substrate, system 10 can include a platen that supports individual substrate portions and conveys them relative to printhead cluster 100. Examples of non-continuous substrates include sheets of paper or cardboard, sheets of polymer, individual food products (e.g., cookies) or electronic components.

In general, the type of jetting fluid may vary. The jetting fluid may be ink (e.g., UV curable ink, hot melt ink, and/or solvent based ink). In some embodiments, the jetting fluid includes an electrically conductive component (e.g., a solder), an electrically insulating component (e.g., a polymer for use as a dielectric in a microelectronic device), or an optically active component (e.g., a component of an organic light emitting material, or a color filter).

Figure 2:
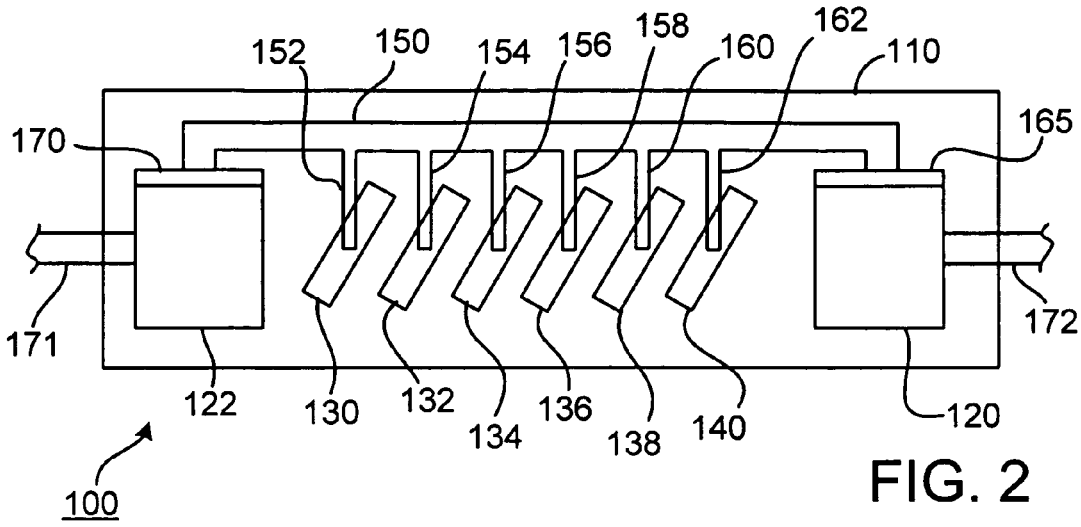
FIG. 2 is a plan view of a printhead cluster.
Figure 3:
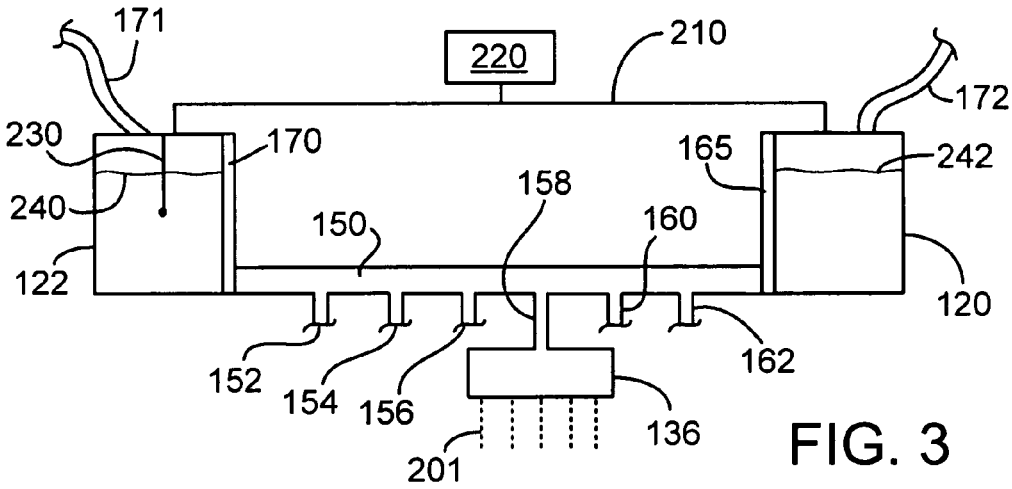
FIG. 3 is a schematic view of a portion of the printhead cluster shown in FIG. 2.

Referring to FIG. 2 and FIG. 3, a printhead cluster 100 includes a housing 110 that holds six jetting assemblies 130, 132, 134, 136, 138, and 140 and two reservoirs 120 and 122.

Reservoirs 120 and 122 are in fluid communication with each other via tube 150 (e.g., a rubber tube). Jetting assemblies 130, 132, 134, 136, 138, and 140 are in fluid communication with reservoirs 120 and 122 respectively via tubes 152, 154, 156, 158, 160, and 162, which connect to tube 150. Fluid is fed to reservoirs 120 and 122 from a remote fluid supply via supply tubes 172 and 171, respectively.

Reservoirs 120 and 122 include deaeration members 165 and 170, respectively, which remove dissolved air from the ink prior to the ink flowing from each reservoir into tube 150. In some embodiments, deaeration members include an air-permeable membrane (e.g., Teflon) that separates the fluid from a chamber. A vacuum is pulled on the air in the chamber removing dissolved air from the fluid adjacent the membrane.

Reservoir 122 also includes a fluid level sensor that detects when the level 240 of fluid in the reservoir drops below a predetermined volume. When such the level drops below this volume, the sensor sends a signal to a pump (not shown), which pumps additional fluid from a remote fluid supply to the reservoir. Although not shown in cluster 100, in some embodiments, a fluid level sensor can be included in reservoir 120 to detect a level 242 of fluid in that reservoir.

Both reservoirs 120 and 122 are connected to a vacuum pump 220 via vacuum line 210. Vacuum pump pulls a vacuum on each reservoir, controlling ambient pressure on fluid in the printhead cluster.

Fluid levels 240 and 242 are maintained so that there is sufficient additional capacity in each reservoir to accommodate changes in the fluid volume that accompany movement of the printhead cluster. In particular, where the printhead cluster is moved, e.g., for cleaning and/or other maintenance, the additional capacity in each reservoir accommodates "sloshing" of fluid between the reservoirs without causing significant pressure fluctuations in jetting assemblies 130, 132, 134, 136, 138, and 140. Unwanted fluid ejection and/or jet depriming can be avoided in this way.

In general, the capacity of reservoirs 120 and 122 may vary. Typically, the reservoir capacity is selected based on the number of jetting assemblies in the printhead cluster and the anticipated throughput of the printing line. In some embodiments, the capacity of reservoir 120 and/or reservoir 122 is in a range from about 50 ml to about 2 liters (e.g., in a range from about 100 ml to about 1 liter, such as about 500 ml). The capacity of reservoir 120 can be the same or different than reservoir 122.

In some embodiments, fluid levels 240 and/or 242 are maintained so that the level is at most about 95% of the capacity of reservoirs 120 and 122, respectively. For example, fluid level 240 and/or 242 can be maintained at about 90% or less (e.g., about 80% or less, about 70% or less, about 60% or less, about 50% or less) of the respective reservoir's capacity.

In general, the distance between reservoirs 120 and 122, and between the reservoirs and jetting assemblies 130, 132, 134, 136, 138, and 140 can vary. In some embodiments, the distance between reservoirs 120 and 122 can be relatively large. For example, in embodiments where cluster 100 is designed to print across a wide substrate, the distance spanned by the assemblies is relatively large, resulting a relatively large distance between the reservoirs. In some embodiments, reservoirs 120 and 122 are about 50 cm or more apart (e.g., about 60 cm, about 70 cm or more, about 80 cm or more, about 90 cm or more, about 100 cm or more, about 110 cm or more, about 120 cm or more, about 130 cm or more, about 140 cm or more, about 150 cm or more).

In some embodiments, the flow resistance of tubes 152, 154, 156, 158, 160, and 162 can be different from tube 150. In some embodiments, the flow resistance of tubes 152, 154, 156, 158, 160, and 162 can be more than tube 150. For example, in embodiments where the jetting assemblies have an overall compliance, increasing the flow resistance of tubes 152, 154, 156, 158, 160, and 162 relative to tube 150 can reduce the magnitude of pressure variations of fluid in the jetting assemblies that result from movement of the printhead cluster. In some embodiments, tubes 152, 154, 156, 158, 160, and 162 have a smaller inner diameter relative to tube 150, resulting in increased flow resistance relative to tube 150. For example, the inner diameter, or bore, of tubes 152, 154, 156, 158, 160, and/or 162 can be about 75% or less (e.g., about 70% or less, about 60% or less, about 50% or less, about 40% or less, about 30% or less, about 20% or less, about 10% or less) of the bore of tube 150.

Although printhead cluster 100 includes six jetting assemblies, in general, embodiments are not so limited. In general, the number of jetting assemblies in a printhead cluster can vary. In some embodiments, a printhead cluster can include more than six jetting assemblies (e.g., seven or more, eight or more, nine or more, ten or more). Furthermore, in general, a printhead cluster can include more than two reservoirs (e.g., three or more, four or more).

Figure 4:
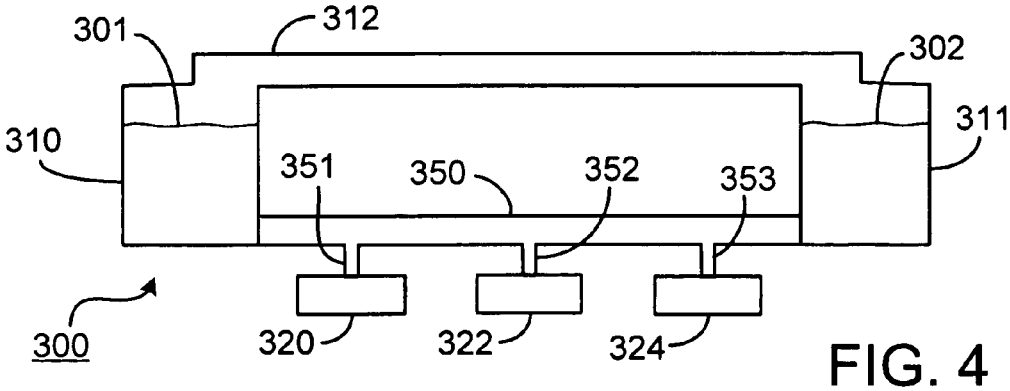
FIG. 4 is a schematic view of another printhead cluster.

While the dual reservoirs in printhead cluster 100 provide a pair of free fluid surfaces to accommodate sloshing of fluid, other arrangements can also be implemented to provide this feature. For example, referring to FIG. 4, in some embodiments, a printhead cluster 300 can utilize a single extended reservoir that includes two portions 310 and 311, each designed to provide a free fluid surface. The free surfaces are shown as surface 301 and surface 302 for portion 310 and 311, respectively. The extended reservoir also includes a third portion 312 (e.g., a tube), which connects portion 310 and 311. The reservoir is in fluid communication with jetting assemblies 320, 322, and 324 via tubes 350 (which connects to portions 310 and 311), and tubes 351, 352, and 353.

Alternatively, in some embodiments, a printhead cluster can include a single reservoir which has a free surface that spans most or all of the jetting assemblies in the cluster. For example, the reservoir could be a pool of ink with pipes to each of the jetting assemblies.

A number of embodiments of the invention have been described. Nevertheless, it will be understood that various modifications may be made without departing from the spirit and scope of the invention. For example, while the foregoing embodiment includes a substrate that is moved while the printhead remains motionless, embodiments can include printhead clusters that move relative to a motionless substrate, or systems in which both the printhead cluster and substrate move relative to a frame that supports the printhead cluster and the substrate. Accordingly, other embodiments are within the scope of the following claims.

What is claimed is:

1. A system, comprising:

a printhead cluster configured to deposit droplets of a jetting fluid on a substrate, the printhead cluster comprising jetting assemblies, a pair of reservoirs to supply the jetting fluid to the jetting assemblies, and a path between the reservoirs, the path configured to permit the jetting fluid to flow in one direction from a first one of the reservoirs to a second one of the reservoirs through a portion of a cross-section of the path, and to flow in the other direction from the second reservoir to the first reservoir through the same portion of the cross-section of the path;

a mounting frame for mounting the printhead cluster relative to the substrate.

2. The system of claim 1, further comprising an electronic controller in communication with the pair of reservoirs and configured to maintain a volume of the jetting fluid in each reservoir at about 95% or less of a maximum volume of the reservoir.

3. The system of claim 1, wherein the path is provided by a first fluid conduit connecting the pair of reservoirs.

4. The system of claim 3, further comprising additional fluid conduits providing a path for the jetting fluid from the first fluid conduit to the jetting assemblies.

5. The system of claim 4, wherein the additional fluid conduits have narrower bores than the first fluid conduit.

6. The system of claim 3, further comprising a second fluid conduit different from the first fluid conduit, the second fluid conduit providing a path for the jetting fluid from the reservoirs to the jetting assemblies.

7. The system of claim 1, wherein the mounting frame includes an assembly that allows the printhead cluster to be moved from a jetting position relative to the substrate to a second position remote from the substrate.

8. An apparatus, comprising:

a jetting assembly comprising a plurality of nozzles capable of ejecting droplets; and a first reservoir and a second reservoir, the first and second reservoirs being in fluid communication with the jetting assembly, the reservoirs being in fluid communication with each other through a path that is configured to permit a jetting fluid to flow in one direction from the first reservoir to the second reservoir through a portion of a cross-section of the path, and to flow in the other direction from the second reservoir to the first reservoir through the same portion of the cross-section of the path.

9. The apparatus of claim 8, wherein the jetting assembly is located about 10 cm or more from the first reservoir.

10. The apparatus of claim 9, wherein the jetting assembly is located about 10 cm or more from the second reservoir.

11. The apparatus of claim 8, wherein the first reservoir is located about 10 cm or more from the second reservoir.

12. The apparatus of claim 8, wherein the first and second reservoirs reduce pressure variations of fluid in the jetting assembly caused by acceleration of the apparatus.

13. The apparatus of claim 12, wherein the pressure variations are sufficiently reduced so that the nozzles are substantially not deprimed when the apparatus accelerates by about 10 $ms^{-2}$ or less, 14. The apparatus of claim 12, wherein the pressure variations are sufficiently reduced so fluid in the jetting assembly substantially does not leak from the nozzles when the apparatus accelerates by about 10 $ms^{-2}$ or less.

15. The apparatus of claim 8, comprising a frame having an opening, where the jetting assembly is positioned in the opening.

16. The apparatus of claim 15, further comprising one or more additional jetting assemblies positioned in corresponding openings in the frame.

17. The apparatus of claim 16, wherein the first and second reservoirs are in fluid communication with the additional jetting assemblies.

18. The apparatus of claim 15, wherein the frame is a portion of an enclosure housing the jetting assembly and the first and second reservoirs.

19. The apparatus of claim 8, wherein the jetting assembly comprises a body and a nozzle plate.

20. The apparatus of claim 19, wherein the body of the jetting assembly comprises a plurality of channels and a piezoelectric actuator, where the channels correspond to nozzles in the nozzle plate and the piezoelectric actuator is configured to cause pressure variations in a fluid in the channels to eject fluid droplets through the nozzles.

21. The apparatus of claim 8, wherein each nozzle is in fluid communication with the first and the second reservoirs.

* * * * *

UNITED STATES PATENT AND TRADEMARK OFFICE

CERTIFICATE OF CORRECTION

PATENT NO. : 7,588,325 B2
APPLICATION NO. : 11/292574
DATED : September 15, 2009
INVENTOR(S) : Edward R. Moynihan It is certified that error appears in the above-identified patent and that said Letters Patent is hereby corrected as shown below:

Column 8, Claim 13, Line 4, delete "less," and insert -- less. --

Signed and Sealed this

Tenth Day of November, 2009

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,588,325 B2
APPLICATION NO. : 11/292574
DATED : September 15, 2009
INVENTOR(S) : Edward R. Moynihan It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 675 days.

Signed and Sealed this

Twenty-first Day of September, 2010

David J. Kappos

David J. Kappos
*Director of the United States Patent and Trademark Office*